United States Patent [19]

DiVincenzo

[11] Patent Number: 4,763,855

[45] Date of Patent: Aug. 16, 1988

[54] FLOSS BOBBIN HOLDING DEVICE

[76] Inventor: Maureen DiVincenzo, P.O. Box 588, Holden, Mass. 01520

[21] Appl. No.: 11,153

[22] Filed: Feb. 5, 1987

[51] Int. Cl.[4] ..... B65H 49/14; B65H 75/06; A47F 5/00

[52] U.S. Cl. ..... 242/139; 211/113; 211/115; 211/163; 223/106; 242/85.1; 242/129.5; 242/130; 242/134

[58] Field of Search ..... 242/139, 141, 146, 134, 242/137, 129.5, 85.1; 211/113, 115, 118, 163; 223/106, 107

[56] References Cited

U.S. PATENT DOCUMENTS

| | | | |
|---|---|---|---|
| 321,624 | 7/1885 | McPherson | 211/115 X |
| 982,216 | 1/1911 | Madden et al. | 211/163 X |
| 1,717,233 | 6/1929 | Lefiell | 211/113 X |
| 1,904,231 | 4/1933 | Hodgman | 211/113 X |
| 1,910,597 | 5/1933 | Elliott | 242/85.1 |
| 4,106,676 | 8/1978 | Freerking | 223/106 |
| 4,161,075 | 7/1979 | Eubanks et al. | 242/85.1 X |
| 4,534,471 | 8/1985 | Zahn et al. | 211/163 X |
| 4,549,664 | 10/1985 | Gowan et al. | 211/163 X |

FOREIGN PATENT DOCUMENTS

| | | | |
|---|---|---|---|
| 26836 | of 1903 | United Kingdom | 242/85.1 |

*Primary Examiner*—Stanley N. Gilreath
*Attorney, Agent, or Firm*—Blodgett & Blodgett

[57] ABSTRACT

A device for holding a plurality of floss bobbins is described. The invention comprises a floss bobbin holding carrier which has a peripheral surface and a plurality of mounting sites on the surface. A plurality of modular floss bobbins are detachably mounted onto the floss bobbin holding carrier, which are arranged spatially on the peripheral surface of the floss bobbin holding carrier.

6 Claims, 3 Drawing Sheets

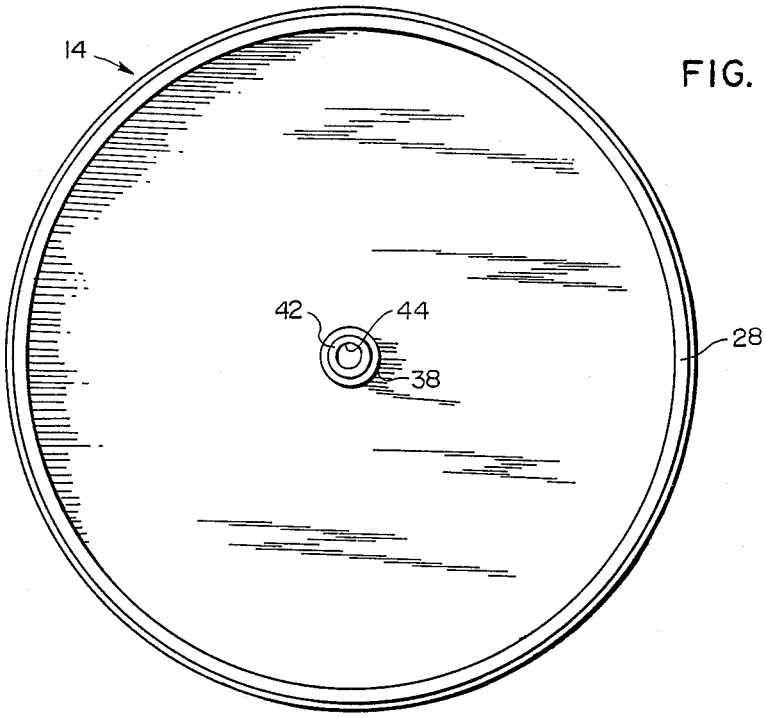
FIG. 3
FIG. 5
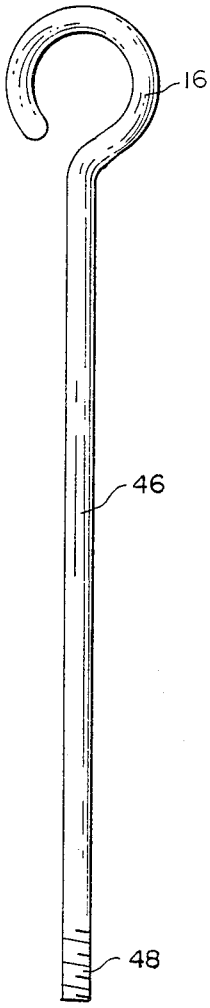
FIG. 4
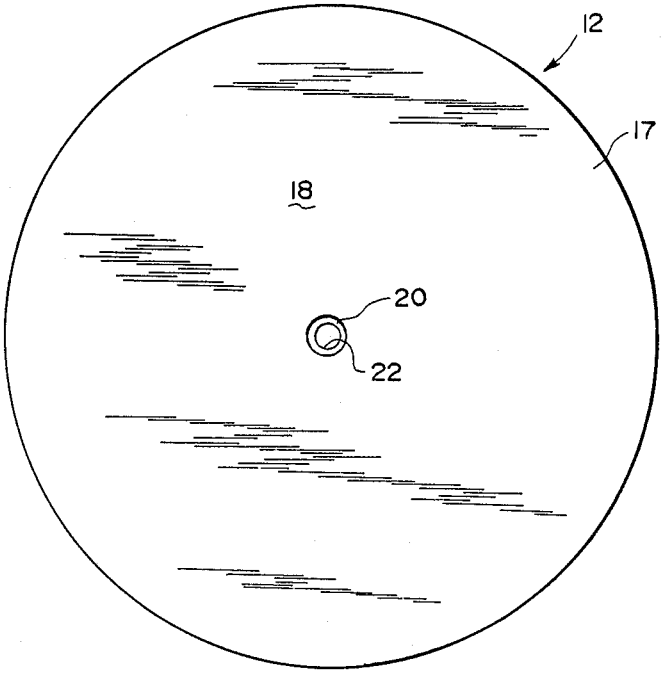

FLOSS BOBBIN HOLDING DEVICE

BACKGROUND OF THE INVENTION

The present invention relates to devices for holding and arranging a plurality of floss bobbins.

The present invention more particularly relates to devices for holding, arranging, and readily interchanging, as well as accessing a plurality of floss bobbins.

In the needlecraft arts, it has long been a major problem to be able to efficiently both organize and handle a plurality of floss bobbins having different color shades.

It has been an additional problem to have rapid access to the individual floss bobbins, when working on a needlepoint, or other needlecraft project, requiring numerous shades of floss to be utilized.

In the past, a plurality of floss bobbins would be difficult to keep in the desired order of varying shades during the project.

SUMMARY OF THE INVENTION

An object of the present invention is to provide a device for holding and arranging floss bobbins.

Another object of the present invention is to provide a device for holding, arranging and readily interchanging, as well as accessing floss bobbins.

A further object of the invention is to provide a novel floss bobbin which is particularly adapted for the holding device of the present invention.

A still further object of the invention is to provide a device for holding floss bobbins which is made up of removable bobbin carrier units for selectively increasing or decreasing the bobbin carrying capacity of the holding device.

In accordance with the above as well as additional objects which will be apparent to those skilled in the arts related thereto, the present invention is set forth in the detailed specification herein, and is to be covered by the claims appended hereto.

The present invention describes a novel device for holding a plurality of floss bobbins, comprising a floss bobbin holding carrier, wherein a plurality of floss bobbins are detachably mounted onto the floss bobbin holding carrier. The floss bobbins are preferably arranged spatially on the peripheral surface of said floss bobbin holding carrier.

BRIEF DESCRIPTION OF THE DRAWINGS

FIG. 3 is a bottom plan view of one of the modular carrier units of the bobbin holding device, FIG. 4 is a top plan view of the supporting base of the bobbin holding device, FIG. 5 is a side elevational view of a connecting rod for connecting the modular elements of the bobin holding device.

DESCRIPTION OF THE PREFERRED EMBODIMENT

Figure 1:
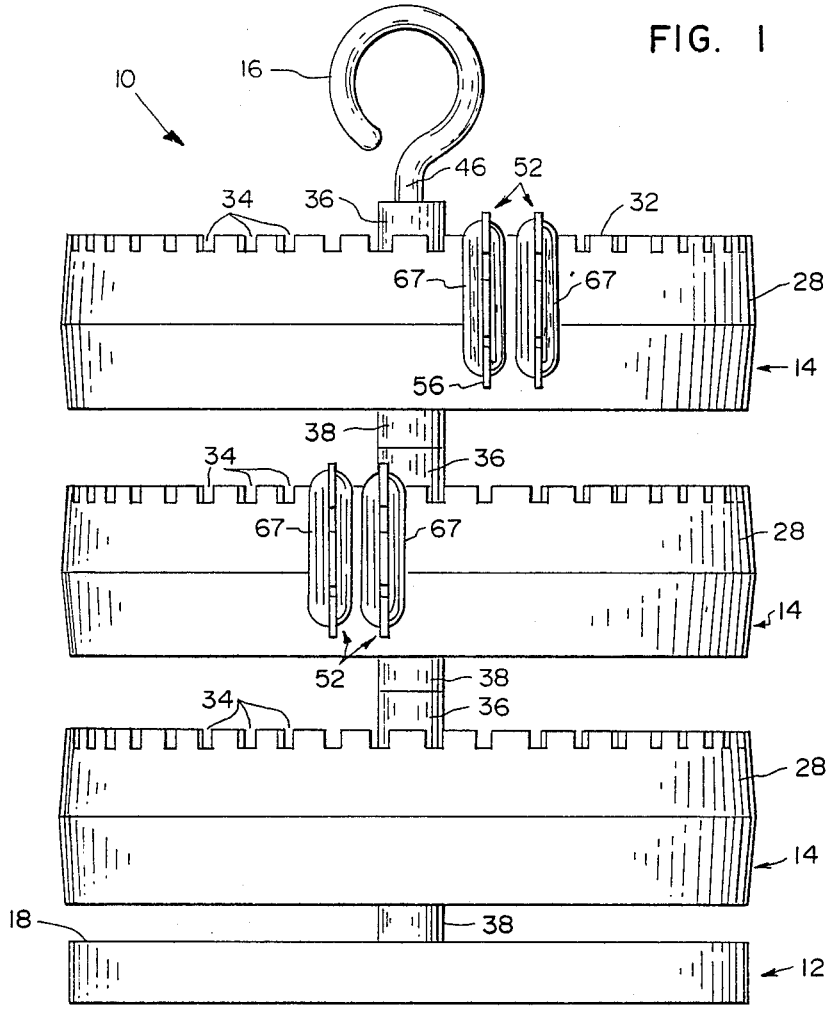
FIG. 1 is a side elevational view of the floss bobbin holding device of the present invention.
Figure 6:
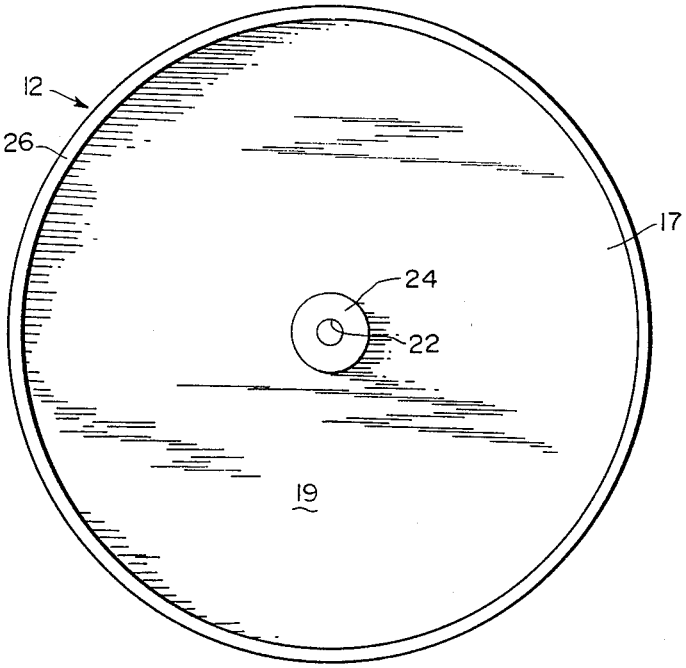
FIG. 6 is a top plan view of the supporting base.
Figure 8:
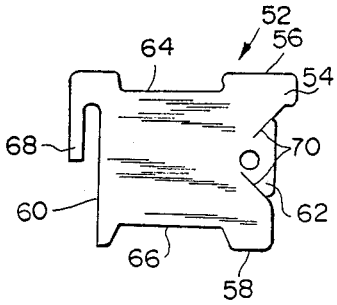
FIG. 8 is a broad side elevational view of novel floss bobbin which is adapted to be held by the holding device of the present invention.
Figure 7:
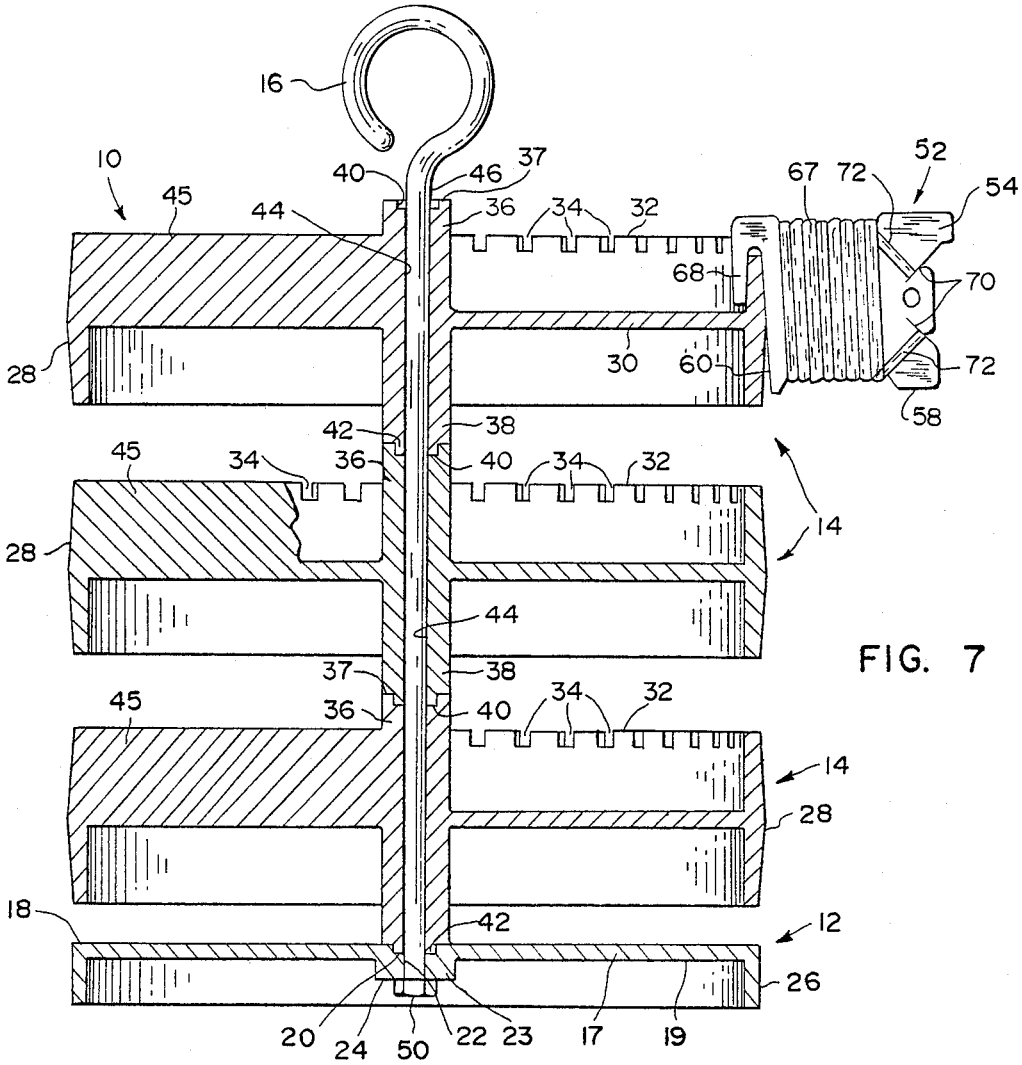
FIG. 7 is a vertical cross sectional view of the bobbin holding device, taken along line VII—VII of FIG. 2.

Referring first to FIG. 1, the floss bobbin holding device of the present invention is generally indicated by the reference numeral 10 and comprises a supporting base 12, one or more modular carrier units 14, and a carrying handle 16. Referring also to FIGS. 4, 6, and 7, the supporting base 12 comprises a horizontal top wall 17 which has a top surface 18 and a bottom surface 19. The top surface 18 has a circular depression 20 and a circular aperture 22 which is concentric with the depression 20 and extends entirely through the horizontal wall 17. A central protrusion 23 is also concentric with the depression 20 and has a bottom surface 24 which extends below the surface 19 of the bottom wall 17. An annular vertical wall 26 extends downwardly from the horizontal wall 17 about the outer periphery of the horizontal wall to a point which is below the surface 24 of the protrusion 23.

Referring to FIGS. 1, 2, 3, and 7, each modular carrier unit 14 comprises an annular vertical wall 28 and a horizontal wall 30 which extends within the confines of the vertical wall 28 from a vertical midpoint of the vertical wall. The vertical wall 28 has a top edge 32 which has a plurality of spaced vertical notches 34. A central upper vertical post 36 extends upwardly from the wall 30 and has a top surface 37 which is above the top edge 32. A vertical lower central vertical post extends downwardly from the horizontal wall 30 to a point below the bottom edge of the vertical wall 28. The top surface 37 of the vertical post 36 has a central annular depression 40. The bottom end of the lower central vertical post 38 has an annular projection 42 which is adapted to fit into the annular depression 40 of a second modular carrier unit 14 or the annular depression 20 of the supporting base 12. This enables the carrier unit 14 to rotate relative to the base 12 or to another carrier unit 14 about a central vertical axis. The modular carrier unit 14 has a central bore 44 which extends entirely through the carrier unit from the top of the upper post 36 to the bottom of the lower post 38. The central bore 44 is concentric with the bore 22 of the supporting base when the carrier unit is mounting on the supporting base. The space which is defined by the horizontal wall 30 and the portion of the vertical wall 28 which extends upwardly from the horizontal wall 30 represents a storage area for craft tools associated with floss bobbins. A plurality of vertical walls 45 extend upwardly from the horizontal wall 30, see FIG. 2 in particular, for dividing the storage space into separate storage compartments.

Referring to FIGS. 1, 5, and 7, there is shown an elongated vertical rod 46 which has a lower threaded end 48 and an upper end which is configured to form the carrying handle 16. The rod 46 is adapted to be inserted into the central bore 44 of the carrier units 14 and the aperture 22 of the supporting base 12 as shown in FIG. 7. A nut 50 is threaded onto the threaded end 48 of the rod 46 for anchoring the rod to the supporting base and allowing the supporting base, together with one or more modular carrier units, to be lifted by grasping the carrying handle 16.

Figure 2:
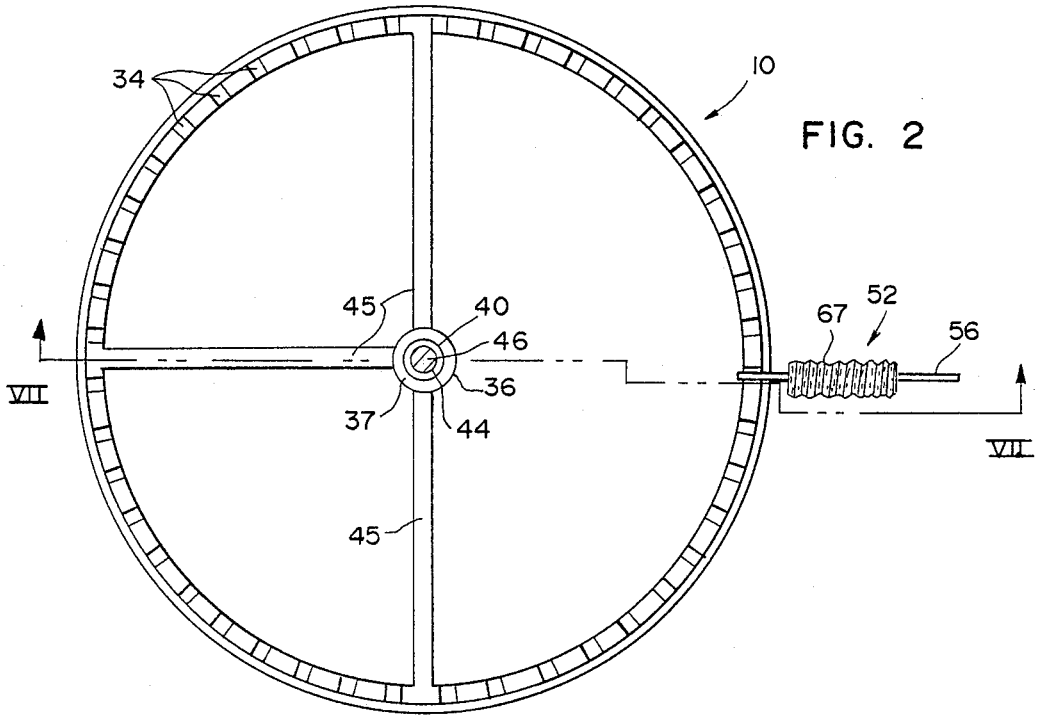
FIG. 2 is a plan view of the floss bobbin holding device of FIG. 1.

Referring to FIGS. 1, 2, 7, and 8, the floss bobbin of the present invention which is particularly adapted for being mounted on the floss bobbin holding device 10 is generally indicated by the reference numeral 52 and comprises a planar body 54. The body 54 has a top edge 56, a bottom edge 58, a first side edge 60, and a second side edge 62. The top edge 56 has a groove 64 and the bottom edge 58 has a groove 66 which is vertically aligned with the groove 64. Floss 67 is wound around the body of the bobbin 54 along the grooves 64 and 66 as shown in FIGS. 2 and 7. A hook-shaped flange 68 extends outwardly and downwardly from the upper portion of the first side edge 60. The flange 68 is adapted to fit over the vertical wall 28 of the carrier unit 14 within one of the slots 34 as shown in FIGS. 2 and 7. The second side edge 62 has a pair of slits 70 for anchoring the ends 72 of the floss as shown in FIG. 7.

The operation and advantages of the present invention will now be readily understood in view of the above description. The floss bobbin holding device 10 is assembled by placing a modular carrier unit 14 so that the projection 42 rests inside the circular depression 20 of the supporting base 12. If desired, one or more additional carrier units 14 are stacked on top of the first carrier unit by inserting the lower projection 42 of an upper carrier unit into the upper depression 40 of a lower carrier unit. The elongated rod 46 is then inserted through the bores 44 of the carrier units and through the aperture 22 of the supporting base. The nut 50 is threaded onto the lower end 48 of the elongated rod 46. This enables the supporting base and the stack of modular carrier unis to be lifted as a unit by grasping and raising the carrying handle 16. Each modular carrier unit 14 can be rotated about the axis of the rod 46 relative to the supporting base or other carrier units 14. Floss bobbins 52 are mounted on each carrier unit 14 by inserting the hooks 68 into the slots 34. Since the slots 34 are spaced from each other, the bobbins 67 will also be spaced from each other. The floss bobbins can be arranged by color and even by different shades of color in any pattern which is convenient to the user. Since the bobbins 52 extend outwardly from the periphery of each carrier unit, they are highly visible and accessible. Also, since each carrier unit 14 can be rotated about the vertical axis of the rod 46, selection of desired bobbins is greatly enhanced. Additional carrier units 14 can be mounted on the first carrier unit as shown in FIG. 1. Each carrier unit can be rotated relative to the other carrier units and to the base 12 about the axis of the rod 46. The floss bobbins 52 are mounted on the carrier unit 14 by hooking the flange 68 over the top edge of the vertical wall 28 within the notches 34. The bobbins are separated from each other due to the spacing of the notches and are readily accessible. The bobbins can be arranged by color and numerous shades of color and are highly visible. The examination and selection of bobbins is greatly enhanced by the ability of the carrier units to be rotated about the vertical axis of the rod 46.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A device for holding a plurality of generally planar floss bobbins, each of which has a hook-shaped flange at one side edge, said holding device comprising:
   (a) a supporting base having a top surface which has a circular depression,
   (b) a carrier which is mounted on said base for rotation about a vertical axis, said carrier comprising:
      (1) a peripheral wall having a top edge,
      (2) an upper central circular post which extends upwardly from the carrier, said post having a top surface which is above said top edge and which has a circular depression, and
      (3) a lower central circular post which extends downwardly from said carrier and which is rotatably and removably mounted in the circular depression of said supporting base or in the circular depression of a second identical carrier which is rotatably and removably mounted on said supporting base, and
   (c) a plurality of floss bobbin mounting sites spatially arranged along said peripheral wall, each of said sites being adapted for receiving the flange of a floss bobbin for supporting the bobbin.

2. A floss bobbin holding device as recited in claim 1, wherein said peripheral wall is a vertical annular wall with said top edge being annular and each of said mounting sites is a vertical notch in said top edge.

3. A floss bobbin holding device as recited in claim 2, wherein said carrier has an upper horizontal surface which is located below said top edge within said annular wall and defining with said vertical wall a storage compartment for floss craft implements.

4. A floss bobbin holding device as recited in claim 3, wherein there is at least one vertical interior wall for dividing said compartment into at least two storage areas.

5. A floss bobbin holding device as recited in claim 1, wherein said carrier has a central bore which is concentric with the upper and lower post of said carrier and said floss holding device further comprises:
   (a) an elongated rod which is adapted to extend through the said central bore, the upper end of said rod being configured for grasping, and
   (b) connecting means for removably attaching the lower end of the rod to said supporting base for enabling the holding device to be carried by grasping the upper end of said rod.

6. A floss bobbin holding device as recited in claim 5, wherein the lower end of said rod is threaded and said connecting means comprises:
   (a) a central bore in said base which is concentric with the central bore of said carrier for receiving the threaded lower end of said rod, and
   (b) a nut which is adapted to be threaded to the threaded lower end of said rod.

* * * * *